US006695080B2

(12) United States Patent
Presley et al.

(10) Patent No.: US 6,695,080 B2
(45) **Date of Patent: *Feb. 24, 2004**

(54) REAMING APPARATUS AND METHOD WITH ENHANCED STRUCTURAL PROTECTION

(75) Inventors: W. Gregory Presley, Spring, TX (US); Christopher S. Charles, Houston, TX (US); Steven R. Radford, The Woodlands, TX (US); Matthew J. Meiners, Spring, TX (US); Mark E. Morris, Lafayette, LA (US); D. Jay Clinkscales, Spring, TX (US); Jeffrey B. Lund, The Woodlands, TX (US); Robert A. Laing, Spring, TX (US); Matthew D. Mumma, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/120,208

(22) Filed: Apr. 10, 2002

(65) Prior Publication Data

US 2002/0166703 A1 Nov. 14, 2002

Related U.S. Application Data

(63) Continuation-in-part of application No. 09/638,626, filed on Aug. 25, 2000, now Pat. No. 6,397,958.

(60) Provisional application No. 60/153,282, filed on Sep. 9, 1999.

(51) Int. Cl.[7] ..... E21B 10/26

(52) U.S. Cl. ..... 175/391; 175/398

(58) Field of Search ..... 175/57, 61, 75, 175/334, 385, 391, 398

(56) References Cited

U.S. PATENT DOCUMENTS

| | | | |
|---|---|---|---|
| 4,440,244 | A | 4/1984 | Wiredal |
| 4,635,738 | A | 1/1987 | Schillinger et al. |
| 5,009,271 | A | 4/1991 | Maric et al. |
| 5,279,375 | A | 1/1994 | Tibbitts et al. |
| 5,460,233 | A | 10/1995 | Meany et al. |
| 5,495,899 | A | 3/1996 | Pastusek et al. |
| 5,497,842 | A | 3/1996 | Pastusek et al. |
| 5,678,644 | A | 10/1997 | Fielder |
| 5,706,906 | A | 1/1998 | Jurewicz et al. |
| 5,765,653 | A | 6/1998 | Doster et al. |
| 5,957,223 | A | 9/1999 | Doster et al. |
| 5,992,542 | A | 11/1999 | Rives |
| 6,000,483 | A | 12/1999 | Jurewicz et al. |
| 6,039,131 | A | 3/2000 | Beaton |
| 6,116,356 | A | 9/2000 | Doster et al. |
| 6,213,226 | B1 | 4/2001 | Eppink et al. |
| 6,227,312 | B1 | 5/2001 | Eppink et al. |
| 6,386,302 | B1 | 5/2002 | Beaton |
| 6,394,200 | B1 | 5/2002 | Watson et al. |

*Primary Examiner*—Frank Tsay
(74) *Attorney, Agent, or Firm*—TraskBritt

(57) ABSTRACT

A method and apparatus for reaming or enlarging a borehole with the ability to drill cement, cement float equipment, and debris out of a casing without substantial damage to the casing interior or the reaming apparatus. The reaming apparatus also provides enhanced protection from contact with the casing wall for selected structural features and elements thereof.

44 Claims, 12 Drawing Sheets

REAMING APPARATUS AND METHOD WITH ENHANCED STRUCTURAL PROTECTION

CROSS-REFERENCE TO RELATED APPLICATIONS

This application is a continuation-in-part of application Ser. No. 09/638,626, filed Aug. 15, 2000 now U.S. Pat. No. 6,397,958, and claims the benefit of U.S. provisional patent application, Ser. No. 60/153,282, filed Sep. 9, 1999.

BACKGROUND OF THE INVENTION

1. Field of the Invention

The present invention relates generally to enlarging the diameter of a subterranean borehole and, more specifically, to enlarging the borehole below a portion thereof which remains at a lesser diameter. The reaming method and apparatus of the present invention include the capability to drill out cement and float equipment resident in a casing above the borehole interval to be enlarged with substantially no damage to the casing interior or the reaming apparatus. The reaming method and apparatus of the present invention also provide the capability to clean up and remove cement, cement float equipment, debris, and other contaminates that have formed restrictions within a cased or open borehole. The reaming apparatus of the present invention also provides enhanced protection for selected structural features and elements thereof.

2. State of the Art

It is known to employ both eccentric and bi-center bits to enlarge a borehole below a tight or undersized portion thereof.

An eccentric bit includes an eccentrically, laterally extended or enlarged cutting portion which, when the bit is rotated about its axis, produces an enlarged borehole. An example of an eccentric bit is disclosed in U.S. Pat. No. 4,635,738.

A bi-center bit assembly employs two longitudinally superimposed bit sections with laterally offset axes. The first axis is the center of the pass-through diameter, that is, the diameter of the smallest borehole the bit will pass through. This axis may be referred to as the pass-through axis. The second axis is the axis of the hole cut as the bit is rotated. This axis may be referred to as the drilling axis. There is usually a first, lower and smaller diameter pilot section employed to commence the drilling, and rotation of the bit is centered about the drilling axis as the second, upper and larger diameter main bit section engages the formation to enlarge the borehole, the rotational axis of the bit assembly rapidly transitioning from the pass-through axis to the drilling axis when the full-diameter, enlarged borehole is drilled.

Rather than employing a one-piece drilling structure such as an eccentric bit or a bi-center bit to enlarge a borehole below a constricted or reduced-diameter segment, it is also known to employ an extended bottomhole assembly (extended bi-center assembly) with a pilot bit at the distal or leading end thereof and a reamer assembly some distance above. This arrangement permits the use of any bit type, be it a rock (tri-cone) bit or a drag bit, as the pilot bit. Further, the extended nature of the assembly permits greater flexibility when passing through tight spots in the borehole as well as the opportunity to effectively stabilize the pilot bit so that the pilot hole and the following reamer will take the path intended for the borehole. This aspect of an extended bottomhole assembly is particularly significant in directional drilling.

While all of the foregoing alternative approaches can be employed to enlarge a borehole below a reduced-diameter segment, the pilot bit with reamer assembly has proven to be highly effective. The assignee of the present invention has, to this end, designed as reaming structures so-called "reamer wings" in the very recent past, which reamer wings generally comprise a tubular body having a fishing neck with a threaded connection at the top thereof and a tong die surface at the bottom thereof, also with a threaded connection. As an aside, short-bodied tools frequently will not include fishing necks, including the short-bodied reamer wings designed by the assignee of the present invention. The upper midportion of the reamer wing includes one or more longitudinally extending blades projecting generally radially outwardly from the tubular body, the outer edges of the blades carrying superabrasive (also termed "superhard") cutting elements; commonly such superabrasive cutting elements, or cutters, are frequently comprised of PDC (Polycrystalline Diamond Compact) cutters. The lower midportion of the reamer wing may include a stabilizing pad having an arcuate exterior surface of the same or slightly smaller radius than the radius of the pilot hole on the exterior of the tubular body and longitudinally below the blades. The stabilizer pad is characteristically placed on the opposite side of the body with respect to the reamer wing blades so that the reamer wing will ride on the pad due to the resultant force vector generated by the cutting of the blade or blades as the enlarged borehole is cut.

While the aforementioned reamer wing design enjoyed some initial success, it was recognized that the device as constructed might not effectively and efficiently address the problem or task of achieving a rapid transition from pass-through to full-hole or "drill" diameter which closely tracks the path of the pilot bit and which does not unduly load the blades or bottomhole assembly during the transition. Since a reamer wing may have to re-establish a full-diameter borehole multiple times during its drilling life in a single borehole, due to washouts and doglegs of the pilot hole, a rapid transitioning ability when reaming is restarted as well as a robust design which can accommodate multiple transitions without significant damage was recognized as a desirable characteristic and design modification. U.S. Pat. No. 5,497,842, assigned to the assignee of the present invention and hereby incorporated by reference herein, discloses the use of so-called "secondary" blades on the reamer wing to speed the transition from pass-through to drill diameter with reduced vibration and borehole eccentricity.

While the improvement of the '842 patent has proven significant, it was recognized that further improvements in the overall stability of the bottomhole assembly, including transitioning from pass-through to drill diameter, would be highly desirable. One problem the prior art reamer assembly designs have experienced is undue vibration and even so-called bit "whirl," despite the focused or directed force vector acting on the reaming assembly and the presence of the stabilization pad. These undesirable phenomena appear to be related to the configuration of the stabilization pad (illustrated in FIG. 5 of the '842 patent), which engages the borehole wall axially and circumferentially under the radially directed resultant force vector of the reamer wing as the assembly drills ahead in the pilot hole, due to the pad's abrupt radial projection from the reamer wing body. Furthermore, it was observed that the entire bottomhole reaming assembly as employed in the prior art for straight-hole drilling with a rotary table or top drive often experiences pipe "whip" due to lack of sufficient lateral or radial stabilization above the reamer wing. In addition, reaming assemblies driven by downhole steerable motors for so-called directional or navigational drilling experienced problems with stability under the lateral forces generated by the reamer wing so as to make it difficult to maintain the planned borehole trajectory.

U.S. Pat. No. 5,765,653, assigned to the assignee of the present invention and hereby incorporated by reference herein, addresses the aforementioned problems by providing an axially as well as circumferentially tapered pilot stabilizer pad (see FIGS. 4, 6, 7 and 7A of the '653 patent), to which may optionally be added one or more eccentric stabilizing elements above the reaming apparatus (see FIGS. 8–12 of the '653 patent).

One remaining problem with the use of state of the art reaming apparatus is the inability to rotate the apparatus while passing the reaming apparatus through a casing above a borehole interval to be enlarged without damage to the casing interior or to the apparatus. This is due, in large part, to the fact that there are typically, but not necessarily, three points of contact (also termed "pass-through points") between the casing and the reaming apparatus, a stabilization pad as disclosed in the aforementioned '842 and '653 patents, and radially outer edges of two of the blades of the apparatus. It is the two outer blade edges which are of primary concern, as PDC cutters thereon may scrape and damage the casing interior, and damage to the PDC cutters from such contact may shorten the life of the apparatus and even cause it to drill an under-gage enlarged borehole below the casing. Further, the inability to rotate the reaming apparatus without such damage effectively precludes rotation of the apparatus to remove float equipment still present within the borehole that was used in cementing the casing into the borehole.

Additionally, not being able to rotate the reaming apparatus without likely incurring such damage is a major impediment in clearing a column of cement residing in the casing above the float equipment or in clearing a portion of casing that has become constricted with scale, chalk, mineral deposits, sand, paraffin, wax or other deposits or debris. Since rotation within the interior of a casing will, of necessity, be around the pass-through axis of the apparatus rather than about the drill axis of the apparatus, the pilot bit is thus rotated eccentrically about the casing interior, so that contact with cement and float equipment, for example, within the casing causes substantial lateral forces which impel the reamer blades against the casing wall, to the detriment of both the blades and the casing. Thus, it is typically necessary to drill out the casing and float equipment with another bit or milling tool, separately trip that bit or tool out of the borehole, and subsequently run the reaming apparatus into the borehole, an obviously time-consuming and expensive process. Therefore, there remains a need for a reaming apparatus capable of casing drill out without substantial damage to the casing interior or to the apparatus itself before continuing on to enlarging the borehole below the constriction provided by the casing or to conduct some other mission.

A further need within the art is for a reaming apparatus capable of being used for both casing drill out as well as open, or uncased, borehole drill out of cement, cement float equipment, debris, and borehole contaminants such as scale, wax, paraffin, or other unwanted substances which typically adhere to and form a buildup on the interior of the casing or borehole, especially when the borehole is being used to produce hydrocarbons.

Yet another need within the art is for a reaming apparatus design which effectively protects radially outer portions of the blades thereof as well as bearing elements and PDC cutters carried at such locations.

BRIEF SUMMARY OF THE INVENTION

The present invention provides a design for an apparatus for enlarging the diameter of a borehole, which reaming apparatus may also be termed a "ream while drilling (RWD) tool" or a "reamer wing". The reaming apparatus of the invention is effective in enlarging the borehole diameter and also affords protection for the structure of the apparatus while running through casing, as well as for casing through which the tool is run. Thus, drill out of cement and float equipment resident in the casing may be effected without damage to the casing interior or to the reaming apparatus so that, after drill out, the tool may effect the desired enlargement of the borehole below the casing. While it is contemplated that the reaming apparatus of the invention will commonly be run above a pilot bit for drilling the borehole to be enlarged immediately thereafter by the reaming apparatus, the invention is not so limited, as it may be applied to enlarging an existing borehole.

One aspect of the invention comprises longitudinally and circumferentially enlarging the surface area of radially outer surfaces of gage pads on blades of the tool above the superabrasive PDC cutters (as the tool is normally oriented during drilling) which contact the casing interior during rotation therein, and providing such surfaces with bearing elements exhibiting bearing surfaces to ride on the casing interior. The bearing surfaces may preferably be overexposed (e.g., extend radially beyond) with respect to the drill diameter of the tool to provide additional protection while passing through the casing, and be formed of a material which will quickly wear after passage through the casing when reaming therebelow. Further, the bearing surfaces may be enhanced in terms of size, orientation and conformity to the interior wall of the casing by providing at least one flat thereon. Moreover, the bearing elements may optionally comprise superabrasive cutting elements, such as PDC cutting elements having suitably configured tables having surfaces oriented so as to be generally nonaggressive and thus allowing selected surfaces of the superabrasive tables of the superabrasive elements to serve as bearing surfaces.

It is also contemplated that one or more ovoid, or at least partially hemispherical, headed tungsten carbide compacts may be placed on the radially outer surface of a blade and facing generally radially outwardly, for example, on a rotationally trailing blade and/or on a rotationally leading blade, thus being circumferentially offset from a given blade, to provide an additional pass-through point to accommodate the erratic rotational pattern of the tool in the casing during drill out. Such compacts may also be provided with a PDC or other superabrasive material bearing surface over at least a portion of the head.

Another aspect of the invention comprises positioning superabrasive cutters, such as PDC cutters, on a blade so as to be circumferentially and rotationally offset from a radially outer, rotationally leading edge portion of a blade where a casing contact point is to occur. Such positioning of the cutters rotationally, or circumferentially, to the rear of the casing contact point located on the radially outermost leading edge of the blade allows the cutters to remain on proper drill diameter for enlarging the borehole, but are, in effect, recessed away from the casing contact point.

Still another aspect of the invention comprises forming the rotationally leading edges of the reamer blades to be nonaggressive, which design may be employed with the pilot bit blades if a drag bit is employed for same.

Yet another aspect of the invention comprises reducing the aggressiveness of superabrasive gage cutters, such as PDC gage cutters, on the blades which are likely to contact the casing through the use of so-called carbide supported edge (CSE) PDC cutters in accordance with U.S. Pat. No. 5,460,233, such PDC cutters also preferably having a relatively large bevel, or rake land, on the diamond table in accordance with U.S. Pat. No. 5,706,906 and related U.S. Pat. No. 6,000,483. Each of the three foregoing patents is assigned to the assignee of the present invention and is hereby incorporated by reference herein.

Another feature for reducing aggressiveness of the gage is the use of one or more ovoid or bullet-shaped elements exhibiting at least partial hemispherical heads facing in the direction of rotation, preferably immediately below the gage and at least slightly leading the superabrasive gage cutters. These elements may be in the form of tungsten carbide compacts or may comprise so-called "dome" PDC cutters having at least partial hemispherical leading surfaces. In lieu of discrete elements, a suitably shaped protrusion may be formed on one or more blades at suitable locations, and hardfacing applied thereto by techniques known in the art.

A still further aspect of the present invention is the use of bearing elements, such as tungsten carbide (WC) inserts, diamond inserts, diamond grit-filled WC inserts, or ovoid-headed elements in the outer bearing surfaces of the pilot stabilizer pad to control wear of the pad over an extended drilling interval.

An additional aspect of the invention resides in the use of side- or rotationally backward-facing cutters on the pilot bit to assist during drill out and to protect the rotationally forward-facing cutters of the pilot bit from impact-induced delamination of the diamond tables from their substrates during the eccentric rotation of the pilot bit as drill out is effected. Omnidirectional cutters, as disclosed and claimed in U.S. Pat. No. 5,279,375, assigned to the assignee of the present invention and hereby incorporated by reference herein, may also be employed on the pilot bit to assist in drill out and for cutter protection.

A further aspect of the invention comprises, where the tool has a sufficient number of blades so that a radially outer edge of one or more blades is substantially removed from any proximity to the casing interior, placement of PDC cutters on those blades at extended radial positions to define a diameter in excess of the drill diameter to provide a safety margin in terms of ensuring a reamed interval of adequate diameter and to extend the interval of drill diameter drilled by the reamer blades by initially taking wear on the extended-radius cutters.

An additional aspect of the invention comprises a method employing the reaming apparatus of the present invention for passing through an interior diameter restriction of a casing such as a patch landing shoulder, for cleaning up and drilling out cased boreholes below such interior diameter restriction, as well as for cleaning up and drilling out open, or uncased, boreholes. Such drilling out includes, but is not limited to, reaming at least one or more portions of the borehole to an internal diameter approaching the borehole's original internal diameter. Therefore, the subject method is particularly suitable for the cleaning out and/or drilling out of patch landing shoulders in casing, cement, cement float equipment, debris, and borehole contaminants such as scale, wax, paraffin, mineral deposits, or other unwanted substances which typically adhere to and form a buildup on the interior of the casing or borehole and is especially useful for cleaning up cased and uncased boreholes used to produce hydrocarbons.

A further aspect of the present invention includes relocating the blades of the reaming apparatus, and the bearing elements and PDC cutters carried proximate the radially outer ends of the blades, off of, or recessed from, the pass-through diameter of the reaming apparatus. Such relocation protects these structural features by creating a zone of protection to preclude damage to the PDC cutters while rotating in casing as well as in moving through casing which is of a pass-through diameter or greater. Such a relocation of the blades and bearing elements and PDC cutters carried thereby also eliminates any necessity for the radially outer portions of the blades or bearing elements carried thereby to be designed to wear away during reaming of the borehole to an enlarged diameter.

DETAILED DESCRIPTION OF THE INVENTION

Figure 1A:
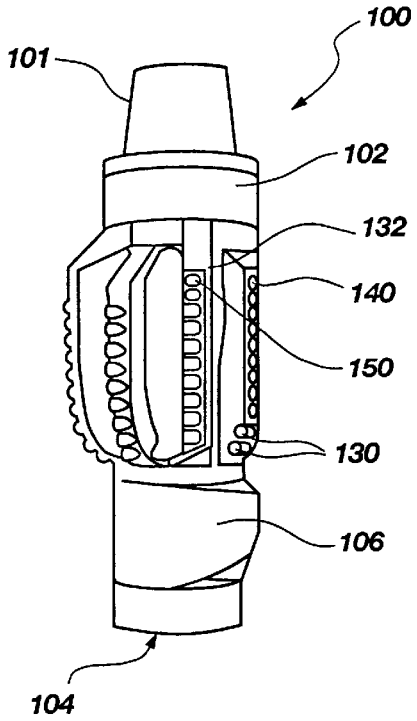
FIGS. 1A and 1B comprise rotationally offset, perspective side elevations of a five-bladed reaming apparatus according to the present invention.
Figure 1B:
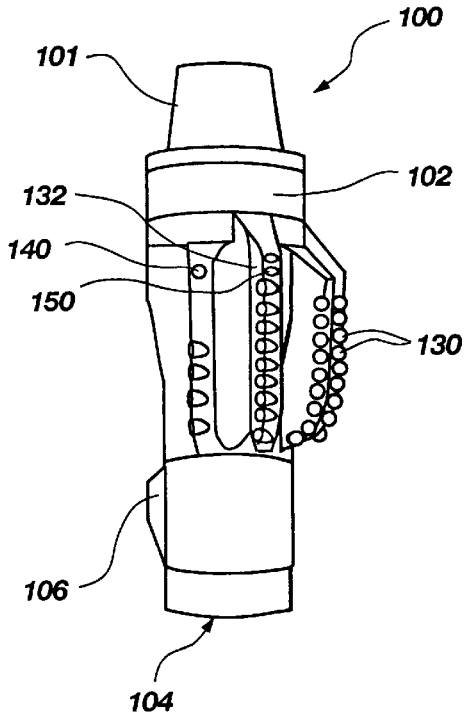
Figure 2:
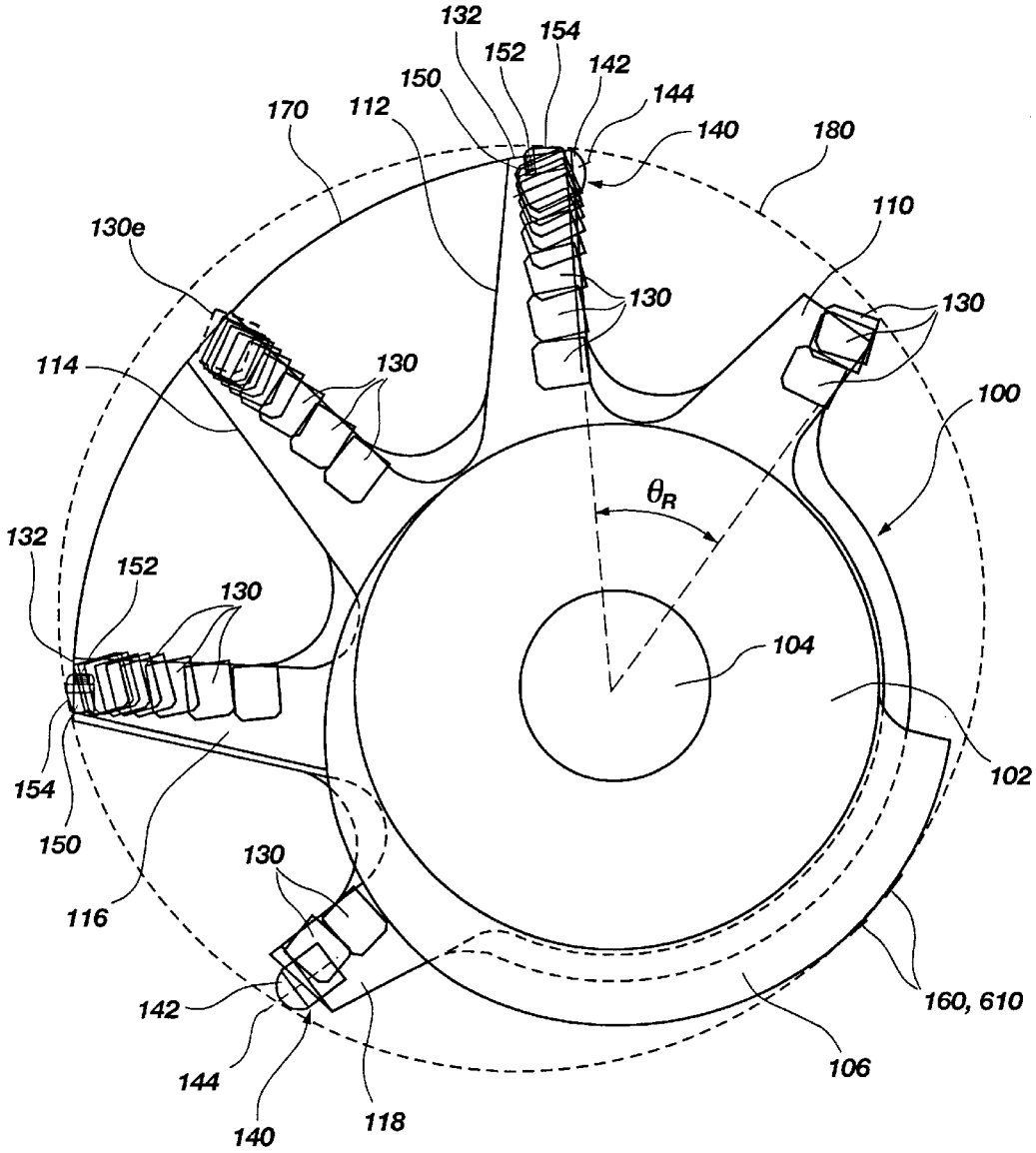
FIG. 2 comprises an enlarged representation of blade, cutter and bearing element placement on the apparatus of FIGS. 1A and 1B, looking downwardly along the longitudinal axis of the tool and within a casing.

FIGS. 1A, 1B and 2 illustrate a first exemplary reamer wing, or RWD (ream while drilling) tool, shown as a steerable RWD tool, or SRWD (steerable ream while drilling) reamer tool 100 comprising a tubular body 102 having an axial bore 104 therethrough. Reamer tool 100 may also comprise a slimhole technology RWD tool, or STRWD (slimhole technology ream while drilling) tool. Reamer tool 100 may be secured in a bottomhole assembly via API threaded connections 101 or any other suitable connections used within the art. Pilot stabilizer pad (PSP) 106 according to the aforementioned '653 patent is disposed on the side of tubular body 102. Circumferentially spaced blades 110, 112, 114, 116, and 118 extend longitudinally and generally radially from body 102. Body 102 and blades 110–118 are preferably formed of steel, and the blades may be integrally formed on body 102, welded to body 102, or otherwise attached to body 102.

It should be noted that the number of blades depicted is exemplary only, and that fewer, including only a single blade, or more than five blades may be employed on a reamer wing, RWD, SRWD, or STRWD tool according to the invention. The preferred or required number of blades is determined not only by the drill diameter to which the borehole is to be enlarged, but also by the relative sizes of the borehole (usually but not always a pilot borehole drilled by a pilot bit secured to the lower end of the reaming apparatus) and the drill diameter. Moreover, the determination of the preferred number of blades to be provided on the reamer tool is influenced by a reamer angle shown as reamer angle $\theta_R$ in FIG. 2. Reamer angle $\theta_R$ is the angle between two adjacent reference lines radially extending from the longitudinal centerline of the tool to the full drill diameter of the tool which will be the point of contact of the radially outermost-positioned cutter on the particular blade with which each of the two reference lines is associated. Thus, if the initial, or preliminary, design of a particular tool results in a reamer angle $\theta_R$ being quite small, a tool designer would likely consider redesigning the tool with at least one less blade to provide a larger, more suitably sized reamer angle $\theta_R$. Conversely, if the design of a particular tool initially results in a reamer angle $\theta_R$ being quite large, a tool designer would likely consider redesigning the tool to have at least one more blade to provide a relatively smaller, more suitable reamer angle $\theta_R$.

Figure 3:
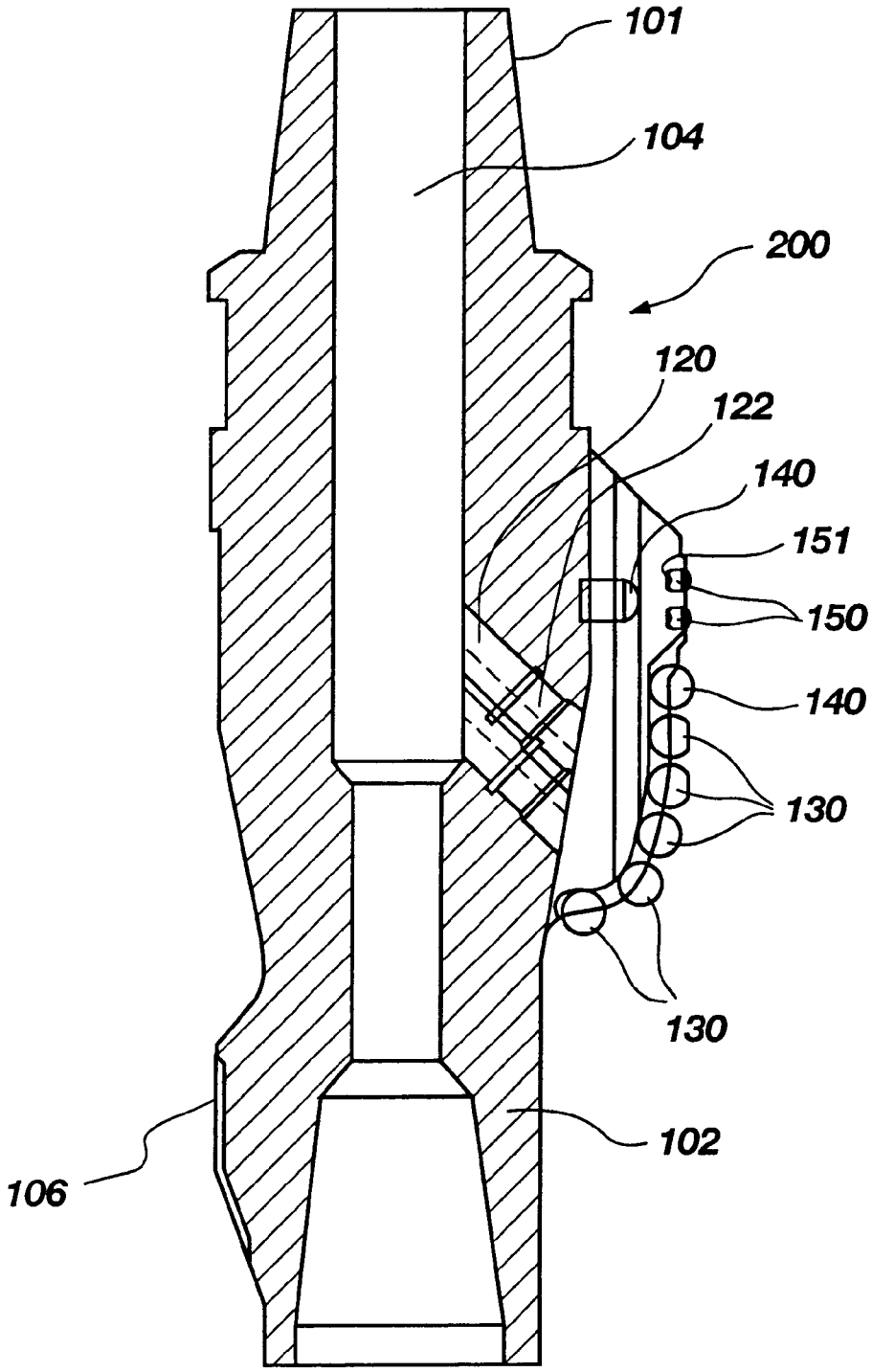
FIG. 3 comprises a side half-sectional elevation of a four-bladed reaming apparatus according to the present invention with all four of the blades rotated into the plane of the page.

As desired or required, one or more passages 120 (see FIG. 3) may extend from axial bore 104 to the surface of body 102 to direct drilling fluid to the blades and cutters thereon via nozzles 122 (see FIG. 3).

The above-described technique of selecting the number of blades on a tool to be used for reaming as well as the provision of passageways for conducting fluid is technology well known to those practicing in the art of drilling subterranean formations.

PSP 106 is located on the lower portion of body 102 closely below blades 110–118. The body 102 on which PSP 106 is located may comprise the same body on which blades 110–118 are located, or may comprise a separate sub, as desired. Circumferential placement of PSP 106 is dictated by the resultant lateral force vector generated by the blades during transition from start-up condition to and during drilling of the drill diameter hole so that the pad rides on the borehole wall as the blades cut the transition and ultimately the full-gage drill diameter.

If desired, PSP 106 may be provided with one or more bearing elements, representatively depicted as reference numeral 160 in FIG. 2. Bearing elements 160 may be tungsten carbide (WC) inserts, diamond inserts, diamond grit-filled WC inserts, or ovoid-headed elements in the outer bearing surfaces of the PSP 106 to control wear of the pad over an extended drilling interval. Optionally, a PDC cutting element such as beveled cutter 610 shown in FIGS. 9A and 9B could be set into PSP 106 in such a manner to be nonaggressive and thus serve as a bearing element 160.

It can be seen that preferably all blades 110–118 carry superabrasive cutters 130, such as PDC cutters, at their lower and radially inner extents which will continue to actively cut after full drill diameter is reached. However, due to the radially smaller extent of the blades 110 and 118, PDC cutters 130 on the flank of blades 110 and 118 will only cut during the transition from start-up to full drill diameter, after which they will no longer contact the borehole sidewall, at which time the cutters on blades 112–116 will still be active. A major function of blade 110 is to effectuate as rapid and smooth a transition as possible to full drill diameter by permitting reamer tool 100 to remove more formation material per revolution and with lower side reaction forces and thus less lateral disruption of assembly rotation than if only more radially outwardly extending blades were employed. While the face and lower flank cutters of all the blades are in continuous engagement with the formation, neither of the blades 110 and 118 or any other portion of reamer tool 100 except for the blades 112–116 will normally contact the borehole sidewall during drilling after the borehole is enlarged to drill diameter.

PDC cutters 130 and particularly those on the gage of the reamer tool 100 may, as noted above, have a substrate and diamond table geometry which reduces the aggressiveness of the cutters and increases the durability of the PDC cutters themselves. Such geometry, in combination with an appropriate selection of cutter back rake with respect to casing wall orientation, may be used to provide a nonaggressive tungsten carbide (substrate) or tungsten carbide and diamond (substrate and diamond table) bearing surface or surfaces. Such cutter configurations and orientations may also be employed to protect the PDC cutters, and specifically the diamond tables thereof, against eccentric rotation or even backward rotation or "whirl" during drill out and subsequent reaming, such phenomenon resulting in damaging effects such as delamination of the diamond tables from the substrates.

Figure 9A:
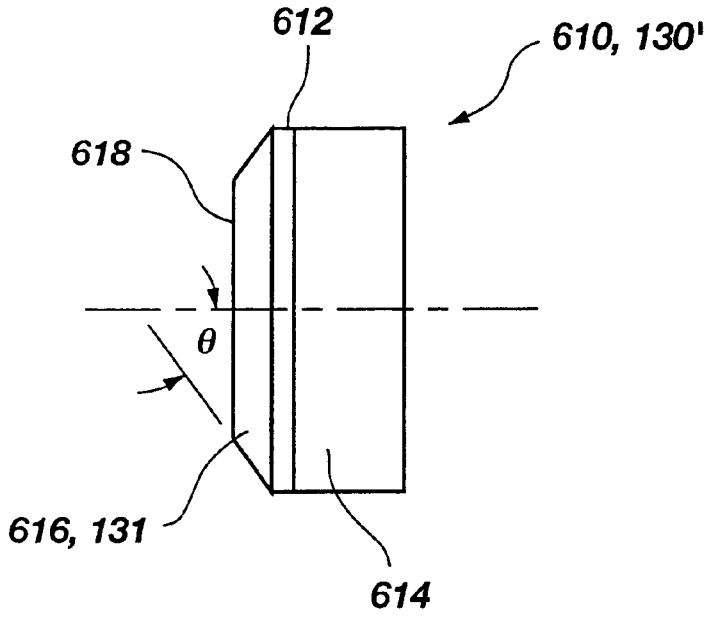
FIGS. 9A and 9B comprise representations of exemplary PDC cutting elements having a PDC table including a relatively large bevel, or rake land, and a flat central area which may be used in lieu of the conventionally configured PDC cutters as generally shown in the preceding drawings.
Figure 9B:
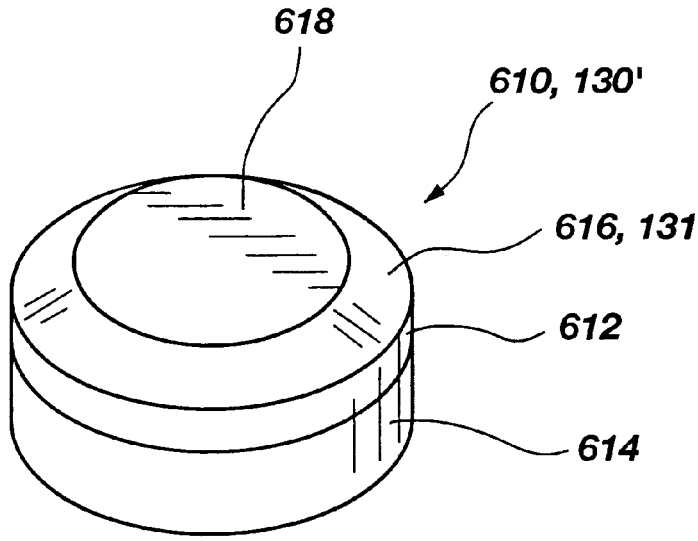

An example of PDC cutters being provided with a cutting face geometry that provides an appropriate level of aggressiveness or nonaggressiveness by way of having a cutting face including a bevel, or rake land, offering increased durability as compared to conventionally configured PDC cutters 130 can be viewed in FIGS. 9A and 9B. The representative cutter shown in FIGS. 9A and 9B is described in detail in U.S. Pat. No. 5,706,906—Jurewicz et al. and related U.S. Pat. No. 6,000,483—Jurewicz et al., both of which were earlier incorporated by reference herein. Exemplary cutter 610, illustrated in FIGS. 9A and 9B, exhibits a superabrasive table, such as a PDC table 612, disposed upon a supporting substrate such as WC substrate 614. PDC table 612 includes a bevel, or rake land, 616 and a generally flat central area 618. Bevel, or rake land, 616 is sloped at a preselected rake land angle θ with 45° from the longitudinal axis of cutter 610 being a rake land angle particularly well suited to serve as a bearing surface in accordance with the present invention when installed on the radially outermost portions of a given blade. Exemplary, alternative cutter 610 is currently marketed by the assignee of the present invention under the trademark DIAX 45. Of course, other rake land angles θ greater or less than 45° may be equally suitable, depending upon the back rake angle of a given PDC cutter of this design with respect to the casing wall.

Referring again to FIG. 2 of the drawings, reamer tool 100 includes not only PDC cutters 130 on blades 110–118 but also bearing elements in the form of ovoid WC inserts 140 on, respectively, blade 112 and blade 118. WC insert 140 on blade 112 is oriented with its substantially hemispherical head 142 rotationally leading the PDC cutters 130 on blade 112, facing generally in the direction of tool rotation and side raked outwardly, for example 20°, from a tangential orientation with respect to the drill diameter 170 to mutually protect PDC cutters 130 and the interior casing wall 180 from each other. WC insert 140 on blade 118 is oriented with its longitudinal axis 144 generally aligned with the lateral protrusion of blade 118 from body 102, so that the outer tip of hemispherical head 142 will contact interior casing wall 180. Blades 112 and 116 carry bearing elements in the form of circumferentially oriented, bullet-shaped WC inserts 150, which have serrated peripheries 152 (only some serrations shown for clarity) for better retention in pockets 151 (viewable in FIGS. 3 and 4) in gage pads 132 of the blades, WC inserts 150 also having preformed bearing surfaces 154 thereon for enhanced bearing surface area size, orientation and conformity with interior casing wall 180. It should be noted that the tungsten carbide grades selected for WC inserts 140 and 150 may be optimized for a suitable combination of toughness and wear-resistance.

As an alternative to WC inserts 150 being made of a tungsten carbide material, a PDC cutting element can readily be used in lieu of a tungsten carbide insert, or button, 150. Thus a PDC cutting element such as exemplary cutter 610 having a generally flat central area, or surface, 618 as illustrated in FIGS. 9A and 9B can readily serve as a low-friction, long-wearing bearing surface in lieu of bearing surface 154 of WC insert 150. That is, a relatively large diameter PDC cutting element, having a PDC table configured to have a relatively large, flat, central surface preferably oriented to face generally radially outwardly from the tool, can be used in lieu of or in combination with previously described WC inserts 150. Additionally, it is advantageous when using a PDC cutting element in lieu of a WC insert to use a PDC cutting element having a significantly large bevel or rake land thereon to prevent unwanted aggressive contact with the casing interior. As mentioned previously, cutter 610 is but one cutter disclosed and taught in U.S. Pat. Nos. 5,706,906 and 6,000,483, referenced previously, and other PDC cutters, whether embodying the technology of such patents or not, may serve as bearing elements in lieu of WC inserts 150. Thus, cutting elements, or cutters, such as exemplary cutter 610 are not only suitable for use in lieu of WC inserts 150 but are also suitable for use in lieu of certain PDC cutters 130 as discussed previously.

It is also contemplated that blade 114 of FIG. 2, which lies substantially remote from interior casing wall 180 during pass through even under rotation, may carry one or more superabrasive cutters such as PDC cutters 130*e* thereon as shown in broken lines which extend radially beyond the drill diameter 170 to be cut by reamer tool 100. Such PDC cutters 130*e* will provide a safety margin in terms of ensuring a reamed interval of adequate (i.e., full drill) diameter and to extend the interval of drill diameter 170 drilled by the reamer blades by initially taking wear on the extended-radius PDC cutters 130*e*.

Referring now generally to FIGS. 3–5C of the drawings and embodiment 200 of the reaming apparatus or tool of the present invention, like elements to those of the embodiment 100 of FIGS. 1A, 1B and 2 will be referenced with the same reference numerals. Reamer tool 200 comprises a tubular body 102 having an axial bore 104 therethrough. Reamer tool 200 may be secured in a bottomhole assembly via API threaded connections or by any other suitable connection known in the art. Pilot stabilizer pad (PSP) 106 according to the aforementioned '653 patent is disposed on the side of tubular body 102. Circumferentially spaced blades 210, 212, 214 and 216 extend longitudinally and generally radially from body 102. Body 102 and blades 210–216 are preferably formed of steel, and the blades may be integral with body 102, welded to body 102, or otherwise securely attached to body 102. As desired or required, one or more passages 120 may extend from axial bore 104 to the surface of body 102 to conduct and direct drilling fluid to the blades and cutters thereon via nozzles 122. Providing such passages and nozzles is technology well known in the drilling art.

PSP 106 is located on the lower portion of body 102 closely below blades 210–216. The body 102 on which PSP 106 is located may comprise the same body on which blades 210–216 are located and thus be integral therewith, or may comprise a separate attachable sub, as desired. Circumferential placement of PSP 106 is dictated by the resultant lateral force vector generated by the blades during transition from start-up condition to and during drilling of the drill diameter hole so that the pad rides on the borehole wall as the blades cut the transition and ultimate drill diameter. It can be seen that all blades 210–216 carry at least one PDC cutter 130 at their lower and radially inner extents which will continue to actively cut after full drill diameter is reached. However, due to the radially smaller extent of the blades 210 and 216, blade 216 carries only a single PDC cutter 130 and the PDC cutter 130 on the flank of blade 210 will only cut during the transition from start-up to full drill diameter, after which it will no longer contact the borehole sidewall, at which time the PDC cutters 130 on blades 212 and 214 will still be active. A major function of blade 210 is to effectuate as rapid and smooth a transition as possible to full, or maximum, drill diameter by permitting reamer tool 200 to remove a greater quantity of formation material per revolution with lower side reaction forces and thus less lateral disruption of tool assembly rotation than if only more radially outwardly extending blades were employed. While the face and lower flank PDC cutters of all the blades are in continuous engagement with the formation, neither of the blades 210 and 216 or any other portion of reamer tool 200 except for the blades 212 and 214 will normally contact the borehole sidewall during drilling after the borehole is enlarged to drill diameter.

Figure 4:
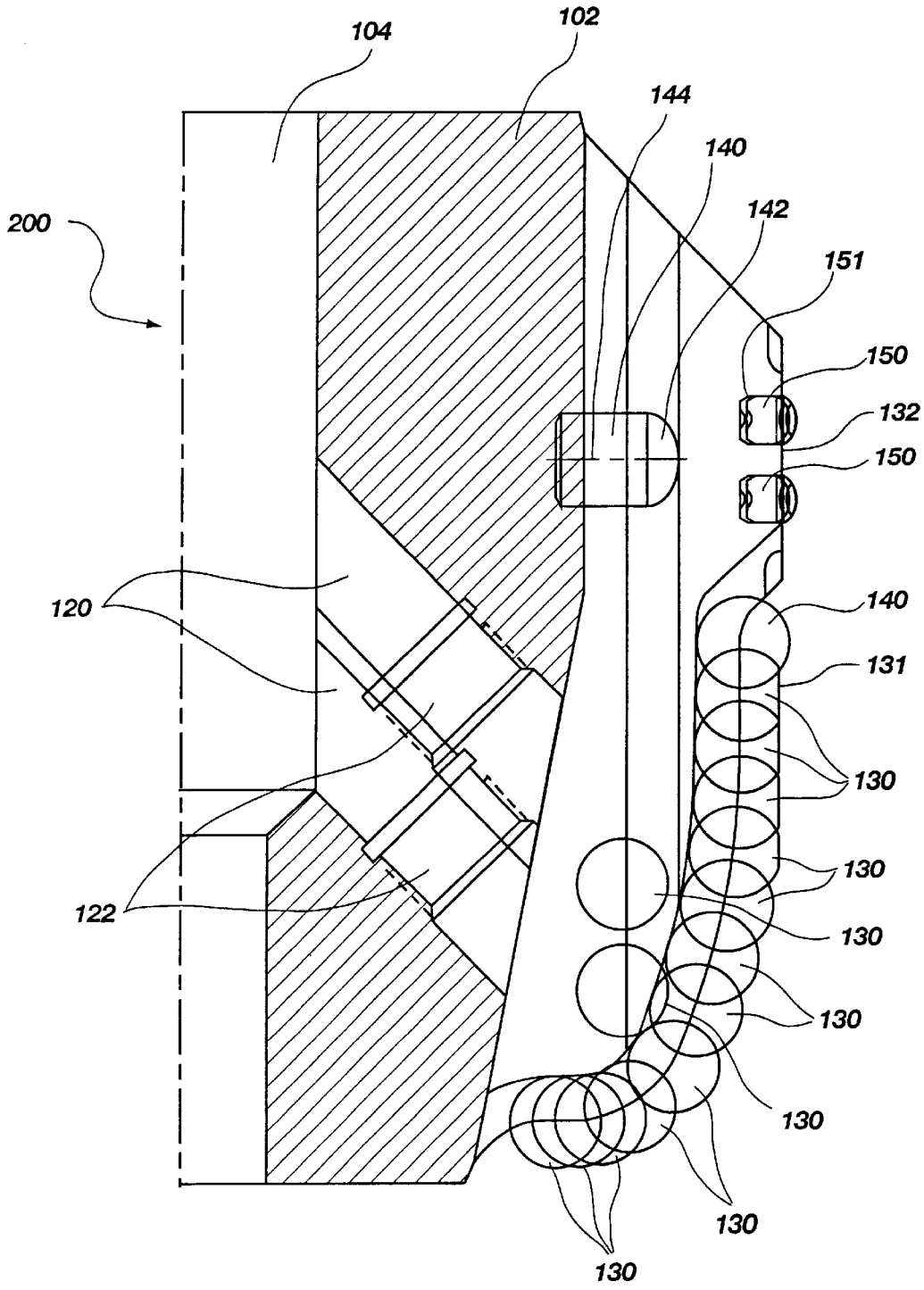
FIG. 4 comprises an enlarged side quarter-sectional elevation of the profile of the reaming apparatus as shown in FIG. 3 to better show cutter and bearing element locations and orientations.
Figure 5A:
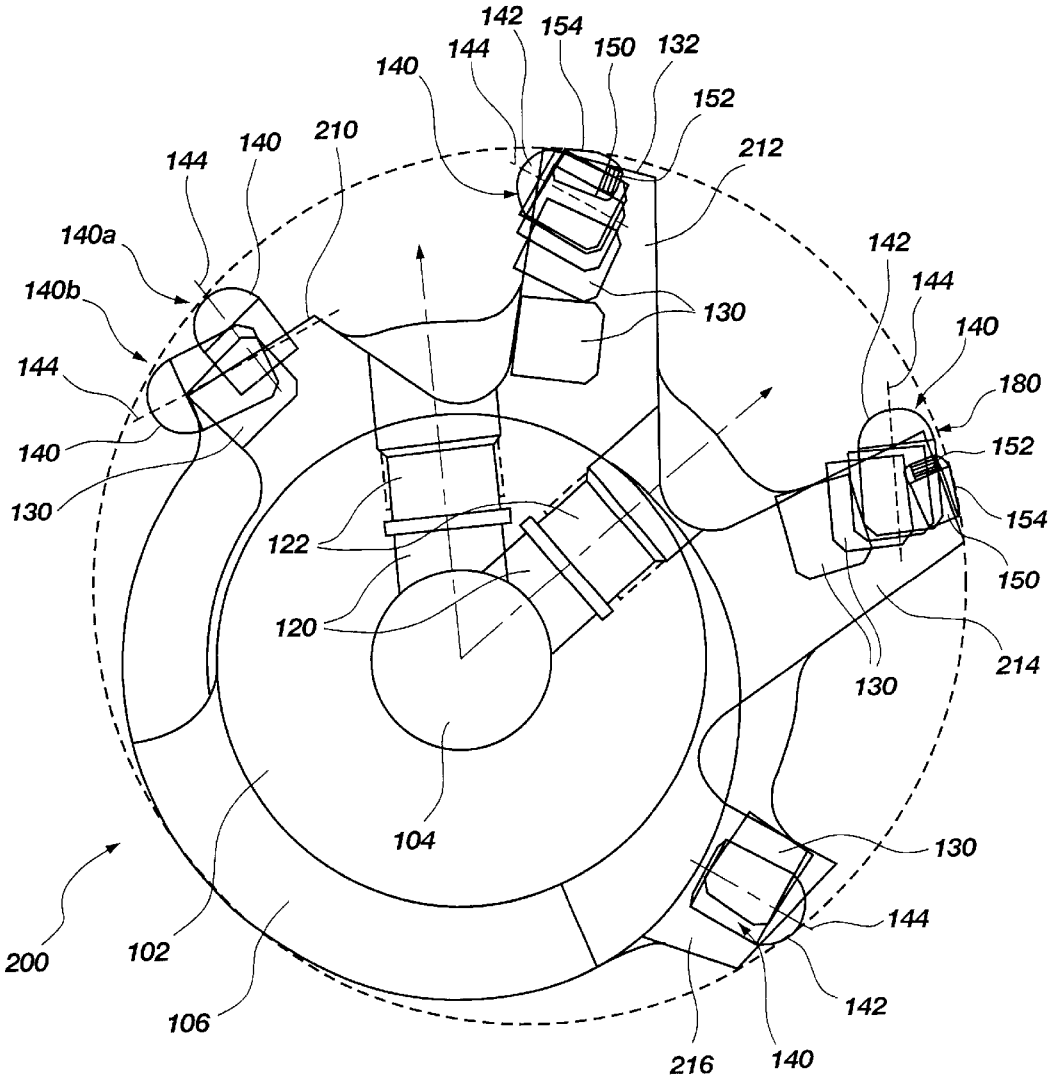
FIG. 5A comprises an enlarged representation of blade, cutter and bearing element placement of a four-bladed reaming apparatus similar to the apparatus of FIG. 4, looking upwardly along the longitudinal axis of the tool and within a casing.

Referring again to FIGS. 3–5C of the drawings, reamer tool 200 includes not only PDC cutters 130 on blades 210–216, but also bearing elements in the preferred form of ovoid WC inserts 140 on blades 210, 212, 214, and 216 as shown in FIG. 5A. Inserts 140*a* and 140*b*, for example, on blade 210 of FIG. 5A are respectively shown being oriented with respect to the radially outermost surface of blade 210, in two exemplary orientations. Insert 140*a* has its longitudinal axis 144 generally aligned with the larger protrusion of blade 210 so that the outer tip of hemispherical head 142 will contact interior casing wall 180. The other insert, insert 140*b* on blade 210, is oriented with its substantially hemispherical head 142 rotationally leading so as to be facing somewhat generally in the direction of tool rotation as well as being side raked outwardly. For example, insert 140*b* on blade 210 is side raked at an exemplary 20° angle, taken from a tangential orientation of longitudinal axis 144 with respect to the drill diameter to mutually protect PDC cutters 130 and especially PDC cutters 130 located near the full drill diameter, or gage, of the tool and the interior casing wall 180 from each other. WC insert 140 on blade 212, located clockwise of blade 210 as depicted in FIG. 5A, is oriented with its substantially hemispherical head 142 rotationally leading, or circumferentially offset from, PDC cutters 130 on blade 212, facing generally in the direction of tool rotation and side raked outwardly, for example 20°, from a tangential orientation of longitudinal axis 144 with respect to the drill diameter to mutually protect PDC cutters 130 and the interior casing wall 180 from each other. WC insert 140 on blade 214 is oriented to face the direction of intended tool rotation in the manner described with respect to WC insert 140 disposed on blade 212. WC insert 140 on blade 216 is oriented with its longitudinal axis 144 generally aligned with the lateral protrusion of blade 216 from body 102, so that the outer tip of hemispherical head 142 will contact interior casing wall 180. Blades 212 and 214 carry, in an exemplary manner, bearing elements in the form of circumferentially oriented, bullet-shaped WC inserts 150, which preferably have serrated peripheries 152 (only some serrations shown in FIG. 4 for clarity) for better retention in pockets 151 in gage pads 132 of the blades, WC inserts 150 also having preformed bearing surfaces 154 thereon for enhanced bearing surface area size, orientation and conformity with interior casing wall 180.

As discussed with respect to reamer tool 100 illustrated in FIGS. 1A, 1B and 2, one or more WC inserts 150 may optionally be replaced with a PDC cutter having a table suitably sized and configured with at least one surface exposed to provide at least one suitable bearing surface to protect interior casing wall 180 and reamer tool 200 from incurring unwanted damage upon reamer tool 200 being passed therethrough or when reamer tool 200 is engaged in casing clean-up and/or drill-out operations. Furthermore, the surface of such a PDC cutter serving as a bearing surface may be polished or otherwise finished to have a very hard, low-friction bearing surface if desired.

Figure 5C:
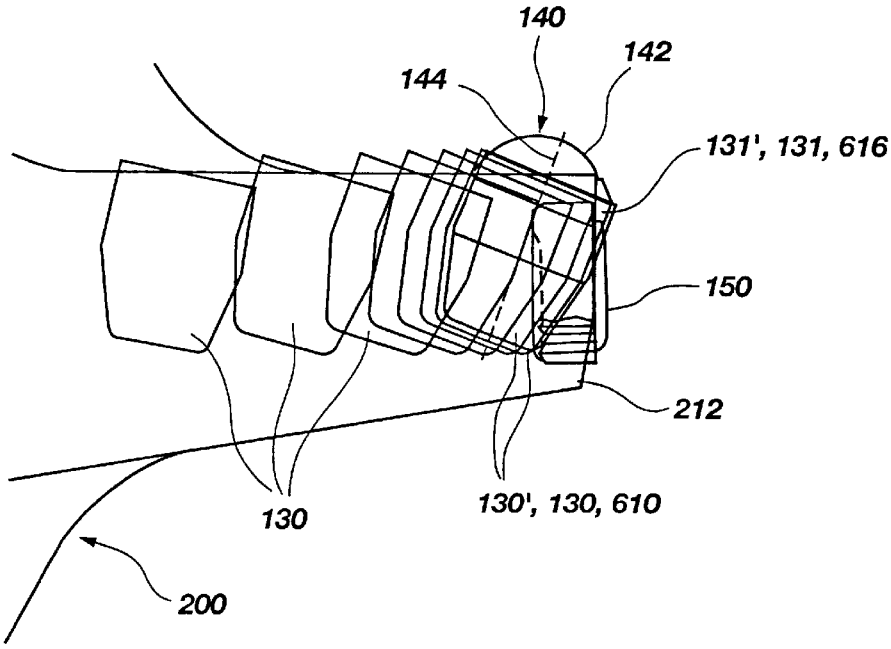
FIG. 5C comprises an enlarged representation of a blade of a reaming apparatus showing the blade of FIG. 5B further having had a generally radially outwardly facing bearing element installed therein.
Figure 5B:
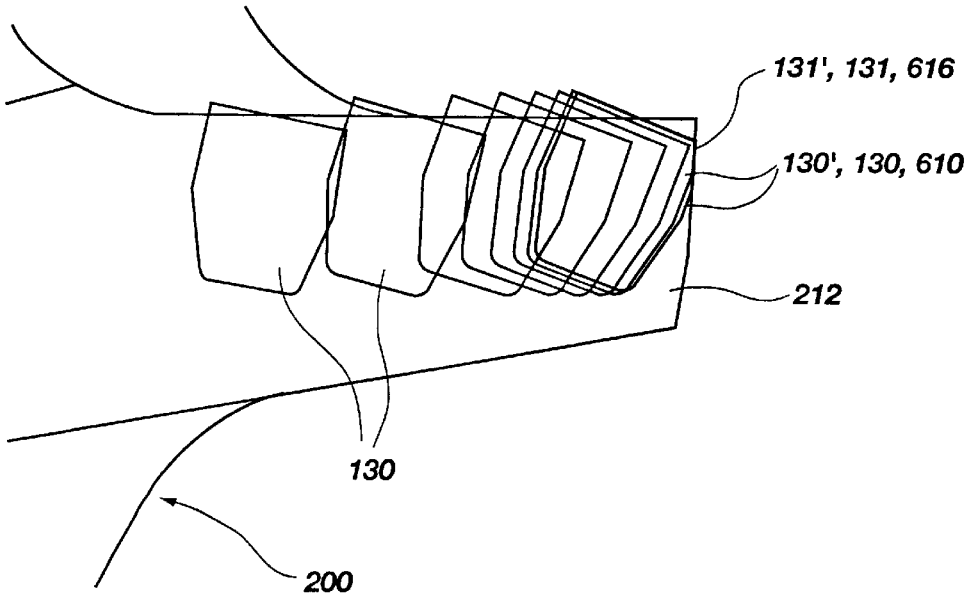
FIG. 5B comprises an enlarged representation of a blade of a reaming apparatus having cutters installed therein but not yet having a generally radially outwardly facing bearing element placed therein according to the present invention; furthermore, radially outermost-positioned cutters are shown having a planar surface either provided on the cutter prior to installation or ground after installation.

Referring in particular to FIGS. 5B and 5C of the drawings, PDC cutters 130 are provided with a planar or ground region 131 as shown in profile in FIG. 4. The planar or ground region 131 of cutters 130 located near the full drill diameter may be provided either by grinding cutter 130 after all cutters 130 are installed in each respective blade of a tool, such as reamer tool 200, or, alternatively, a cutter 130' originally provided with a relatively large bevel region 131' prior to cutter 130' being installed in a respective blade such as representative blade 212 can be used. Cutting elements having such large bevel regions which are particularly suitable for serving as cutters 130' are disclosed within incorporated U.S. Pat. Nos. 5,706,906 and 6,000,483 referred to previously with one such exemplary cutter, designated as cutter 610 having a bevel, or rake land, 616 being illustrated in FIGS. 9A and 9B of the present drawings. Thus, cutter 610 can readily be used in lieu of a conventionally shaped PDC cutter 130 with bevel 610 serving as ground region 131. By using cutters with suitably sized bevel regions, the manufacturing costs of a reamer tool incorporating the present invention can be reduced in comparison to the manufacturing costs incurred in grinding selected cutters 130 after such cutters have been installed in a reamer tool. Furthermore, such preferably beveled cutters can have the facings thereof polished or otherwise provided with a relatively smooth surface so as to reduce the amount of bearing surface friction when the subject cutter surface, or bevel, serves as a bearing surface. Having such a low-friction bearing surface is especially desirable when a tool, such as reamer tool 200, is engaged in clean-out or drill-out operations within a casing and where the possibility of damaging the interior casing wall 180 is to be avoided.

Figure 6:
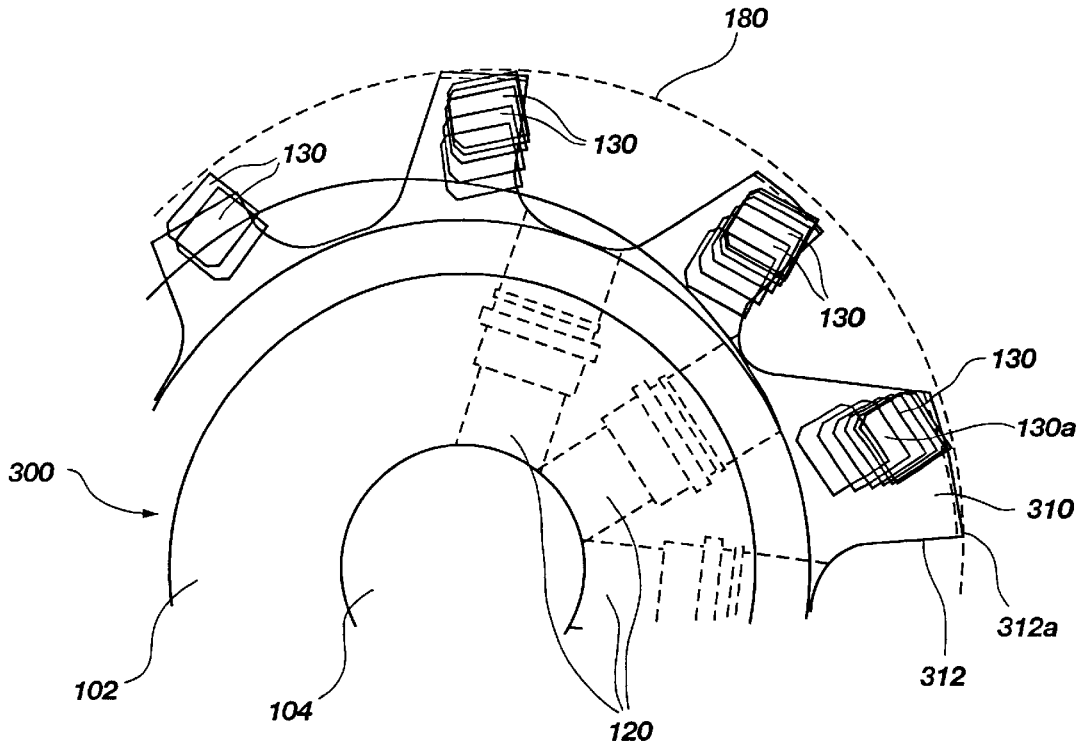
FIG. 6 comprises a representation of a portion of a reaming apparatus according to the present invention within a casing, the cutters of one blade comprising a pass-through point having been rotationally recessed out of potential contact with the casing interior.

Referring now to FIG. 6 of the drawings, elements previously identified with respect to reamer tools 100 and 200 are identified by like reference numerals. FIG. 6 depicts a reamer tool 300 having a plurality of blades (only some shown), wherein an exemplary blade 310 includes thereon a plurality of PDC cutters 130 positioned rotationally to the rear from leading edge 312 of blade 310. In other words, PDC cutters 130 are circumferentially offset, or set back, from leading edge 312 of blade 310 so as to rotationally follow leading edge 312 of blade 310 when reamer tool 300 is rotated in operation. The radially outermost PDC cutter 130*a* on blade 310 is still placed to cut drill diameter, but during pass-through of interior casing wall 180, the radially outermost cutter 130*a* is somewhat radially removed from the radially outermost portion 312*a* of leading edge 312 and interior casing wall 180 so as to mutually protect both cutter 130*a* and interior casing wall 180.

Figure 7A:
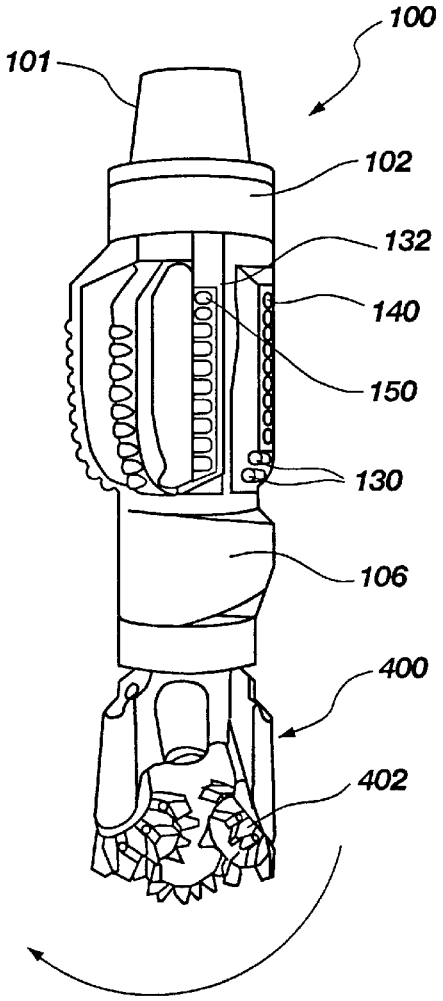
FIGS. 7A and 7B comprise representations of a reaming apparatus according to the present invention in which a pilot bit has been installed on the lowermost portion thereof with FIG. 7A depicting a rock, or roller cone, type bit serving as the pilot bit and with FIG. 7B depicting a drag-type bit serving as the pilot bit.
Figure 7B:
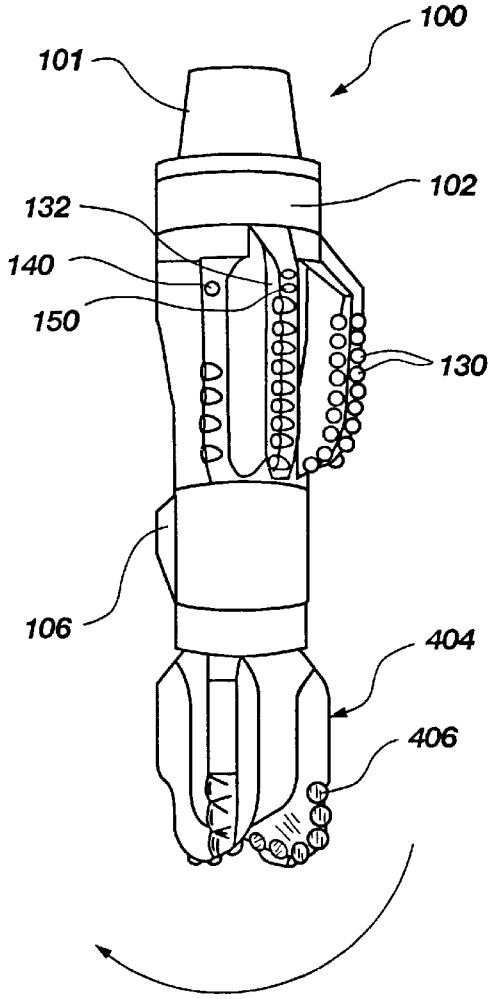

FIGS. 7A and 7B of the drawings, which make use of like reference numerals for elements previously described, each depict reamer tool 100 as having a pilot bit positioned below the lowermost portion of reamer tool 100. Pilot bit 400 shown in FIG. 7A may be any suitably sized roller cone, or rock, bit having movable cutters 402 installed thereon. Pilot bit 400 may be attached to reamer tool 100 so as to form a two-piece tool in accordance with the present invention. If desired, pilot bit 400 may be integrally formed with reamer tool 100 so as to provide a fully integral pilot bit. That is, pilot bit 400 would be integral with reamer tool 100 to form a one-piece reamer tool in accordance with the present invention.

As is customary in the art, rock, or roller cone, type pilot bit 400 is adapted to receive fluid pumped through axial bore 104 (not shown in FIGS. 7A and 7B) and to pass and further direct the fluid into the borehole about the face of the pilot bit to facilitate the drilling and flushing of formation cuttings and debris as the pilot bit rotationally engages the formation or other material to be removed from the borehole as the bit rotates in the direction indicated by the respective arrows. Such debris to be removed can, as an example and without limitation, include material such as cement and downhole cementing equipment including float equipment and landing equipment. If desired, reamer tool 100 and pilot bit 400 may be designed to rotate in the opposite direction shown. Pilot bit 404 shown in FIG. 7B may be any suitably sized drag-type pilot bit likewise adapted to pass and further direct fluid received via axial bore 104 to facilitate the drilling and flushing of formation cuttings and debris as pilot bit 404 engages the formation or other material to be removed. Like rock-type pilot bit 400, drag-type pilot bit 404 may be separately attached to reamer tool 100 to form a two-piece reamer tool in accordance with the present invention. Optionally, drag-type pilot bit 404 may be integrally formed with reamer tool 100 so as to provide a one-piece reamer tool in accordance with the present invention.

Figure 8A:
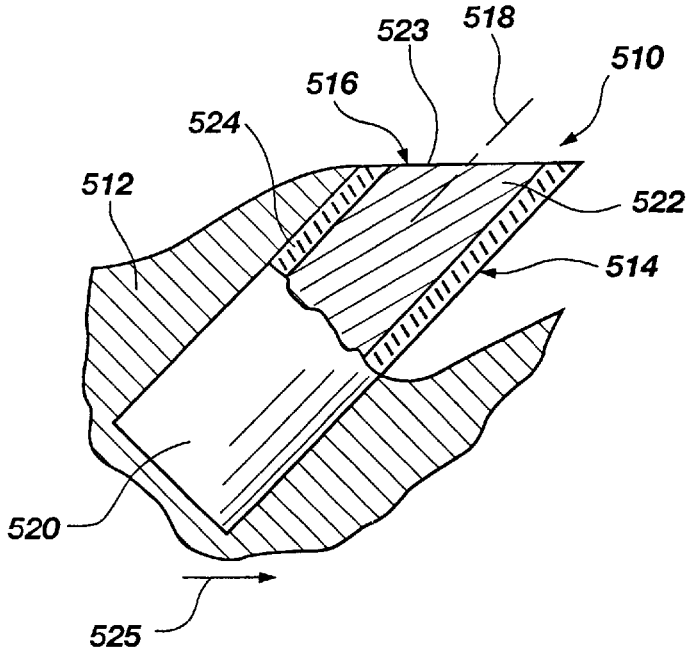
FIGS. 8A and 8B comprise representations of exemplary omnidirectional PCD cutters that may optionally be provided on a pilot bit secured to a reaming apparatus in accordance with the present invention.
Figure 8B:
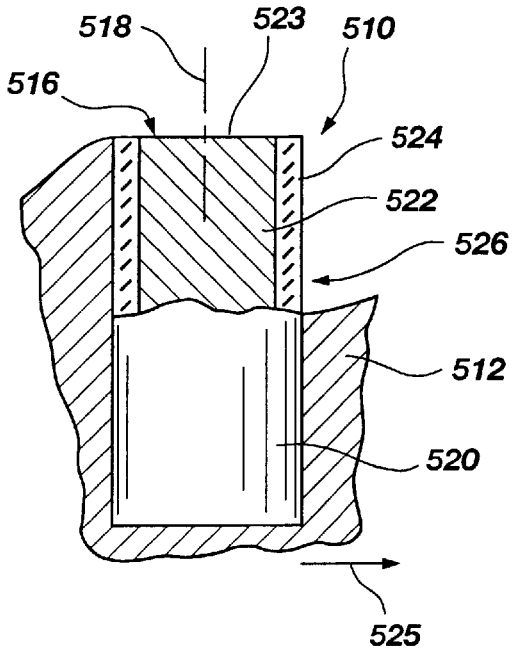

Cutters 406 provided on pilot bit 404 may be conventional PDC-type cutters or specialized cutters such as the multidirectional drill bit cutters disclosed in U.S. Pat. No. 5,279,375 incorporated by reference earlier herein. As a convenience, two of a plurality of exemplary cutters originally disclosed within incorporated U.S. Pat. No. 5,279,375 are shown in FIGS. 8A and 8B hereof. Referring to FIG. 8A, illustrated is an isolated portion of a drill bit 510, such as a drill bit being used as a pilot bit in accordance with the present invention, having a bit body 512 in which exemplary omnidirectional cutter 514 is mounted by processes known within the art. Cutter 514 includes a generally cylindrical stud 516 having a longitudinal axis 518. Stud 516 includes a lower portion 520 which is received within bit body 512 and an upper portion 522 which partially extends from the bit body. Stud 516 may be formed from tungsten carbide, steel, or any other suitable material. Upper portion 522 includes an abrasive layer 524 of polycrystalline diamond. Stud 516 includes an exposed surface 523 at the uppermost end thereof. Layer 524 is substantially tubular in shape and is generally concentric, with respect to longitudinal axis 518, with stud 516. An arrow 525 indicates generally the direction of cutter movement when drill bit 510 rotates.

Referring now to FIG. 8B, illustrated is a second exemplary omnidirectional cutter 526 originally described and illustrated in U.S. Pat. No. 5,279,375. Elements in cutter 526 common to that previously identified on cutter 514 in FIG. 8A are identified by the same numerals. As can be seen in FIG. 8B, cutter 526 includes a stud 516 having an exposed surface 523 which is normal to longitudinal axis 518. The exposed surface of layer 524 on cutter 526 thus presents a different rake angle than the exposed surface of layer 524 on cutter 514 shown in FIG. 8A.

While the various features of the reaming apparatus of the present invention have been described with respect to the portion of the apparatus employed to enlarge the borehole to drill diameter, it is reiterated that any suitable drill bit to serve as a pilot bit, such as an appropriately sized rock bit or a drag bit, securable to the lower end of the body may also be included in the apparatus, as noted above. Toward that end, the pilot bit may be provided with many or all of the above-described features, such as, for example, over-exposed bearing surfaces or elements, including PDC cutting elements sized and configured to serve as such bearing surfaces, to protect the actively aggressive PDC cutters as well as the aforementioned PDC cutter placement and orientation to provide a more robust structure for the cement and float equipment drill out.

Figure 10A:
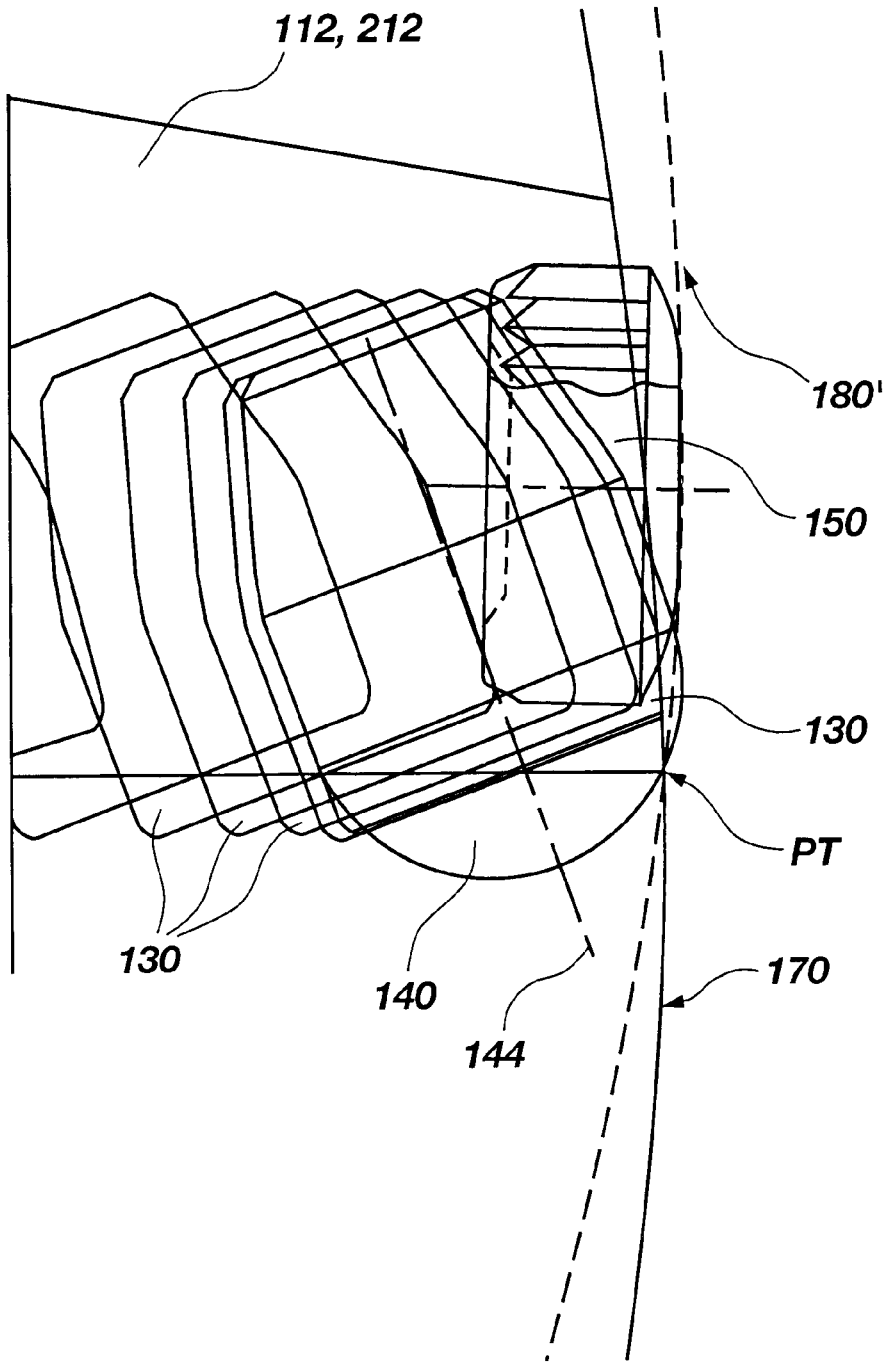
FIGS. 10A and 10B respectively depict a portion of a blade, bearing element and PDC cutter locations projecting beyond the pass-through and drill diameters of the reaming apparatus and relocated so as to be substantially recessed therefrom, the latter in accordance with a further aspect of the present invention.
Figure 10B:
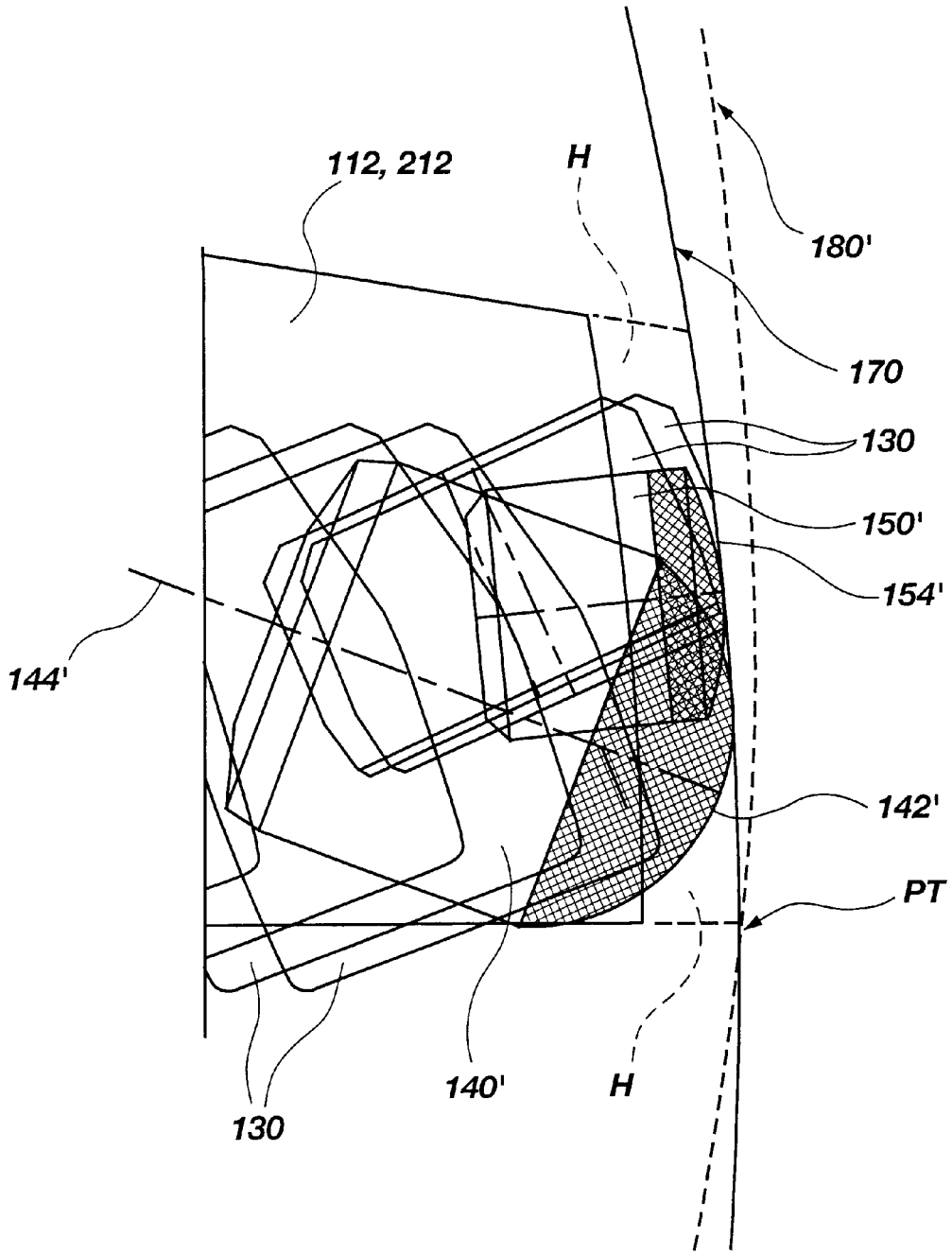

Referring now to FIGS. 10A and 10B of the drawings, a further feature of the present invention will be described. FIGS. 10A and 10B illustrate, in enlarged detail, the radially outer extent, or gage area, of an exemplary blade, such as blade 112 (see FIG. 2) or blade 212 (see FIG. 5A). Blade 112, 212 as depicted in FIG. 10A illustrates conventional blade placement with respect to pass-through point PT, pass-through diameter 180' and drill diameter 170. Conventional placement of PDC cutters 130, ovoid WC inserts 140 and bullet-shaped WC inserts 150 is also shown. As can readily be appreciated from FIG. 10A, PDC cutters 130 at the radially outer extent of blade 112, 212 project to locations extremely close to pass-through diameter 180' (which may, but does not necessarily always, correspond to interior casing wall 180 as shown in FIG. 2), while ovoid WC inserts 140 as well as bullet-shaped WC inserts 150 project beyond the drill diameter 170 and, therefore, must be formed of hard but still wearable WC so as to relatively quickly wear down to the intended drill diameter to prevent an overgage borehole. As depicted, the ovoid WC inserts 140 may project slightly beyond the pass-through diameter 180'. This is due to tolerances on the borehole as well as on the ovoid WC inserts 140 in combination with the drift diameter of the casing, which is rarely exactly the same as, but is usually larger than, the pass-through diameter measured on the tool. Drift diameter may be defined as the diameter which can be passed through over a given length. Since all of the projecting features approaching or exceeding the pass-through diameter 180' are about on the same plane, being only slightly longitudinally offset in comparison to the total length of the reaming apparatus, there is typically not a pass-through problem. Further, and as previously noted, since WC wears relatively quickly against the formation, after which wear, the WC acts as the gage. FIG. 10A further depicts that pass-through point PT actually lies at the outer, rotationally leading or front tip of blade 112, 212.

On the other hand, FIG. 10B illustrates a backward (taken with respect to the direction of rotation of the reaming apparatus) circumferential rotation of blade 112, 212 away from pass-through point PT. Further, the end of blade 112, 212 includes hardfacing H extending out to drill diameter 170. Hardfacing H acts as a bearing surface for the gage while in the formation being reamed. The hardfacing H and inserts 140' and 150' act in combination to protect the PDC cutters 130 which are circumferentially rotated toward the back of blade 112, 212 and protect the casing from contact with the PDC cutters. Superabrasive, and specifically diamond, bearing surface-equipped inserts in the form of insert 140' with hemispherical superabrasive bearing surface 142' and insert 150' with superabrasive bearing surface 154' may be appropriately placed to lie completely within pass-through diameter 180' and have radially outer extents which substantially coincide with drill diameter 170. Further, insert 140' may be positioned or sideraked more radially and thus less tangentially, for example, from an orientation of longitudinal axis 144' of at least about a 45° angle to about a 65–70° angle and, more particularly, about a 68–69° angle to a tangent to the drill diameter (each blade differing somewhat dependent upon the arc of the pass-through diameter 180') than WC insert 140 for a greater degree of wear- and impact-resistance. It is contemplated that inserts 140' may be positioned even more radially and thus less tangentially, for example, from a 70° angle up to and including a 90° angle to the tangent, or radially with respect to the drill diameter, or even past a radial orientation (such as at a 95° angle to the tangent to the drill diameter) so that an insert 140' is actually facing slightly backward with respect to the direction of rotation of the reaming apparatus. Such substantially radial orientations may provide a more favorable load distribution on the hemispherically or dome-shaped superabrasive bearing surface 142' of an insert 140' by placing the majority of the dome surface facing outward toward the outer diameter of the blade 112, 212 on which one or more inserts 140' are mounted.

The redesign of the blade, cutter locations and bearing element locations in accordance with the present invention and as illustrated in FIG. 10B thus removes these structures off of the pass-through point PT of the reaming apparatus. This effectively protects PDC cutters 130 while rotating within a casing of minimum (pass-through) diameter 180' as well as in a larger-diameter casing. The superabrasive protection of inserts 140' and 150' is placed to lie on the drill diameter 170, not to protrude into the pass-through diameter 180'. As shown in FIG. 10B, inserts 140' and 150' may be placed with their respective superabrasive bearing surfaces 142' and 154' lying measurably within the pass-through diameter 180'. This creates an "imaginary" pass-through point on the remaining apparatus, as shown in FIG. 10B, on which the blade 112, 212 may ride while passing through or rotating within casing of pass-through diameter 180' or greater, while the actual pass-through point PT is not actually located on the blade 112, 212.

Many other additions, deletions and modifications of the invention as described and illustrated herein may be made without departing from the scope of the invention as hereinafter claimed.

What is claimed is:

1. A reaming apparatus for enlarging a borehole in a subterranean formation, comprising:

a longitudinally extending body having at least one blade fixed thereto and extending generally radially outwardly therefrom, the at least one blade including at least one superabrasive cutter thereon, the reaming apparatus configured for passage through and rotation about a first axis within a first, pass-through diameter and for rotation about a second, different axis to enlarge the borehole to a drill diameter larger than the pass-through diameter; and at least one bearing element placed at a radially outer extent of at least one of the at least one blade, the at least one bearing element exhibiting a radially outer bearing surface placed for rotation substantially coincident with the drill diameter and for contacting an interior wall of a casing during rotation of the body thereon so that the at least one blade substantially rides on the at least one bearing element.

2. The reaming apparatus of claim 1, wherein the at least one blade extending generally radially outwardly from the longitudinally extending body comprises a plurality of blades and the at least one bearing element placed at a radially outer extent of the at least one blade comprises at least one bearing element placed at a radially outer extent of at least one of the plurality of blades.

3. The reaming apparatus of claim 2, wherein the at least one bearing element comprises a circumferentially extending, substantially bullet-shaped bearing element disposed on a gage pad and having a superabrasive bearing surface.

4. The reaming apparatus of claim 2, wherein the radially outer bearing surface of the at least one bearing element is a superabrasive bearing surface including a flat.

5. The reaming apparatus of claim 2, wherein the at least one bearing element comprises at least two longitudinally spaced, circumferentially extending bearing elements disposed on a gage pad.

6. The reaming apparatus of claim 2, wherein the at least one bearing element comprises a hemispherically headed insert having a longitudinal axis, the hemispherical head having an outer surface formed of a superabrasive material and comprising the radially outer bearing surface.

7. The reaming apparatus of claim 6, wherein the longitudinal axis of the hemispherically headed insert is substantially radially oriented.

8. The reaming apparatus of claim 6, wherein the longitudinal axis of the hemispherically headed insert is oriented substantially in a direction of intended tool rotation and side raked outwardly from a tangent to a drill diameter to be cut by the plurality of blades of the apparatus.

9. The reaming apparatus of claim 8, wherein the longitudinal axis of the hemispherically headed insert is side raked outwardly from the tangent to the drill diameter to be cut by approximately 45–95°.

10. The reaming apparatus of claim 2, further including a pilot bit secured to a lower extent of the body.

11. The reaming apparatus of claim 10, wherein the pilot bit is selected from the group consisting of a rotary drag bit and a rock bit.

12. The reaming apparatus of claim 2, further including a pilot bit integral to a lower extent of the body.

13. The reaming apparatus of claim 12, wherein the pilot bit integral to a lower extent of the body is selected from the group consisting of an integral rotary drag bit and an integral rock bit.

14. The reaming apparatus of claim 11, wherein the pilot bit is a rotary drag bit having a plurality of PDC cutters mounted thereon, at least one of the plurality of PDC cutters being oriented with a diamond table thereof facing other than in a direction of intended tool rotation.

15. The reaming apparatus of claim 13, wherein the pilot bit is a rotary drag bit having a plurality of PDC cutters mounted thereon, at least one of the plurality of PDC cutters being oriented with a diamond table thereof facing other than in a direction of intended tool rotation.

16. The reaming apparatus of claim 2, wherein the at least one superabrasive cutter is at least one PDC cutter.

17. The reaming apparatus of claim 16, wherein the at least one PDC cutter comprises a PDC table configured to include a rake land sloped at a preselected angle with respect to a longitudinal axis of the at least one PDC cutter.

18. The reaming apparatus of claim 17, wherein the at least one PDC cutter comprises a rake land sloped at an angle of approximately 45°.

19. The reaming apparatus of claim 2, wherein at least one blade of the plurality of blades comprises a plurality of superabrasive cutters placed thereon and at least of one of the plurality of superabrasive cutters placed proximate the radially outermost extent of the at least one blade comprises a PDC cutter including a rake land sloped at a preselected angle with respect to a longitudinal axis of the PDC cutter.

20. The reaming apparatus of claim 19, wherein the PDC cutter comprises a rake land sloped at an angle of approximately 45°.

21. The reaming apparatus of claim 2, further including a pilot stabilizer pad on the body below the plurality of blades.

22. The reaming apparatus of claim 21, further including at least one wear-resistant bearing element on a bearing surface of the pilot stabilizer pad.

23. The reaming apparatus of claim 2, wherein at least one superabrasive cutter positioned to cut a drill diameter is circumferentially offset from a rotationally leading edge of at least one of the blades of the plurality.

24. The reaming apparatus of claim 2, wherein at least one superabrasive cutter on one of the blades of the plurality is positioned to cut a diameter greater than the drill diameter.

25. The reaming apparatus of claim 2, further including a longitudinal bore extending through the body and at least one passage extending radially from the longitudinal bore to a nozzle opening onto a side exterior of the body.

26. The reaming apparatus of claim 2, wherein the at least one bearing element comprises a PDC cutting element disposed on a gage pad, the PDC cutting element having a nonaggressive face serving as the radially outer bearing surface.

27. The reaming apparatus of claim 26, wherein the nonaggressive face of the PDC cutting element serving as the radially outer bearing surface is generally flat.

28. The reaming apparatus of claim 2, wherein the at least one bearing element comprises a beveled PDC cutting element including a PDC table configured and oriented to be generally nonaggressive and including a generally flat central area and a rake land sloped at a preselected angle with respect to a longitudinal axis of the beveled PDC cutting element.

29. The reaming apparatus of claim 28, wherein the rake land of the PDC table of the beveled PDC cutting element is sloped at an angle of approximately 45°.

30. The reaming apparatus of claim 2, wherein the at least one bearing element is placed so as not to protrude beyond the pass-through diameter.

31. The reaming apparatus of claim 2, wherein the at least one bearing element is placed with the radially outer bearing surface measurably within the pass-through diameter.

32. The reaming apparatus of claim 2, wherein the at least one blade of the plurality of blades is circumferentially positioned with respect to the body and oriented so as to have a radially outer extent proximate but not coincident with a pass-through point on the pass-through diameter.

33. The reaming apparatus of claim 32, wherein a rotationally leading edge of the at least one blade is rotationally to the rear of the proximate pass-through point.

34. The reaming apparatus of claim 2, wherein a radially outermost superabrasive cutter of the at least one superabrasive cutter on the at least one blade of the plurality of blades is placed to lie substantially within the pass-through diameter.

35. A reaming apparatus for enlarging a borehole in a subterranean formation, comprising:

a longitudinally extending body having a plurality of blades fixed thereto and extending generally radially outwardly therefrom, the blades of the plurality each including at least one superabrasive cutter thereon, the blades in combination oriented, configured and circumferentially positioned for passage through and rotation about a first axis within a first, pass-through diameter and for rotation about a second, different axis to enlarge the borehole to a drill diameter larger than the pass-through diameter; and at least one bearing element placed at a radially outer extent of at least one blade of the plurality, the at least one bearing element exhibiting a radially outer bearing surface placed for rotation substantially coincident with the drill diameter and for contacting an interior wall of a casing during rotation of the body therewithin so that the at least one blade substantially rides on the at least one bearing element.

36. The reaming apparatus of claim 35, wherein the at least one bearing element is placed so as not to protrude beyond the pass-through diameter.

37. The reaming apparatus of claim 35, wherein the at least one bearing element is placed with the radially outer bearing surface measurably within the pass-through diameter.

38. The reaming apparatus of claim 35, wherein the at least one blade of the plurality of blades is circumferentially positioned with respect to the body and oriented so as to have a radially outer extent proximate but not coincident with a pass-through point on the pass-through diameter.

39. The reaming apparatus of claim 38, wherein a rotationally leading edge of the at least one blade is rotationally to the rear of the proximate pass-through point.

40. The reaming apparatus of claim 35, wherein a radially outermost superabrasive cutter of the at least one superabrasive cutter on the at least one blade of the plurality of blades is placed to lie substantially within the pass-through diameter.

41. The reaming apparatus of claim 35, wherein the at least one bearing element comprises a hemispherically headed insert having a longitudinal axis, the hemispherical head having an outer surface formed of a superabrasive material and comprising the radially outer bearing surface.

42. The reaming apparatus of claim 41, wherein the longitudinal axis of the hemispherically headed insert is substantially radially oriented.

43. The reaming apparatus of claim 41, wherein the longitudinal axis of the hemispherically headed insert is oriented substantially in a direction of intended tool rotation and side raked outwardly from a tangent to a drill diameter to be cut by the plurality of blades of the reaming apparatus.

44. The reaming apparatus of claim 43, wherein the longitudinal axis of the hemispherically headed insert is side raked outwardly from the tangent to the drill diameter to be cut by approximately 45–75°.

* * * * *